US008241011B2

(12) United States Patent
Huang

(10) Patent No.: US 8,241,011 B2
(45) Date of Patent: Aug. 14, 2012

(54) FAN HAVING TWO IMPELLERS

(75) Inventor: Chao-Jui Huang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 335 days.

(21) Appl. No.: 12/565,770

(22) Filed: Sep. 24, 2009

(65) Prior Publication Data

US 2011/0052433 A1 Mar. 3, 2011

(30) Foreign Application Priority Data

Aug. 26, 2009 (CN) ..... 2009 1 0306139

(51) Int. Cl.
*F04B 25/00* (2006.01)
*F04B 3/00* (2006.01)
*F04B 5/00* (2006.01)

(52) U.S. Cl. ..... 417/244; 310/112; 310/114; 415/61; 415/68; 416/125; 416/128; 417/423.5

(58) Field of Classification Search ..... 417/2, 244, 417/423.5, 426, 352–356, 53; 416/198 R, 416/199, 120, 124, 128, 129, 125, 130; 310/112, 310/114; 29/888.025; 415/61, 68–69
See application file for complete search history.

(56) References Cited

U.S. PATENT DOCUMENTS

| | | | | |
|---|---|---|---|---|
| 2,121,073 | A * | 6/1938 | De Bothezat | 417/247 |
| 6,537,019 | B1 * | 3/2003 | Dent | 415/61 |
| 6,565,334 | B1 * | 5/2003 | Bradbury et al. | 417/423.1 |
| 7,156,611 | B2 * | 1/2007 | Oosawa et al. | 415/68 |

* cited by examiner

*Primary Examiner* — Devon C Kramer
*Assistant Examiner* — Joseph Herrmann
(74) *Attorney, Agent, or Firm* — Altis Law Group, Inc.

(57) ABSTRACT

A fan includes a first motor having a first rotor and a second motor having a second rotor which is rotationally connected to the first rotor. The fan further comprises a first impeller which, when driven by the first motor, rotates along a first direction and creates a main flow along a direction perpendicular to the periphery thereof and a tangential flow along the tangent thereof. The fan also includes a second impeller which, when driven by the second motor, rotates along the reverse direction of the first direction and impel the tangential flow to the direction perpendicular to the periphery of the first impeller.

1 Claim, 2 Drawing Sheets

FAN HAVING TWO IMPELLERS

BACKGROUND

1. Technical Field

The present disclosure relates to fans and, particularly, to a fan having two contra-rotating impellers.

2. Description of Related Art

Efficiency of conventional fans is typically less than satisfactory because a significant portion of air current created by the fan flowing outwards along a tangent of the fan typically cannot reach the source of heat and accordingly contributes less to the dissipation of heat.

Therefore, a fan which can overcome the above-mentioned problems is desired.

DETAILED DESCRIPTION

Figure 1:
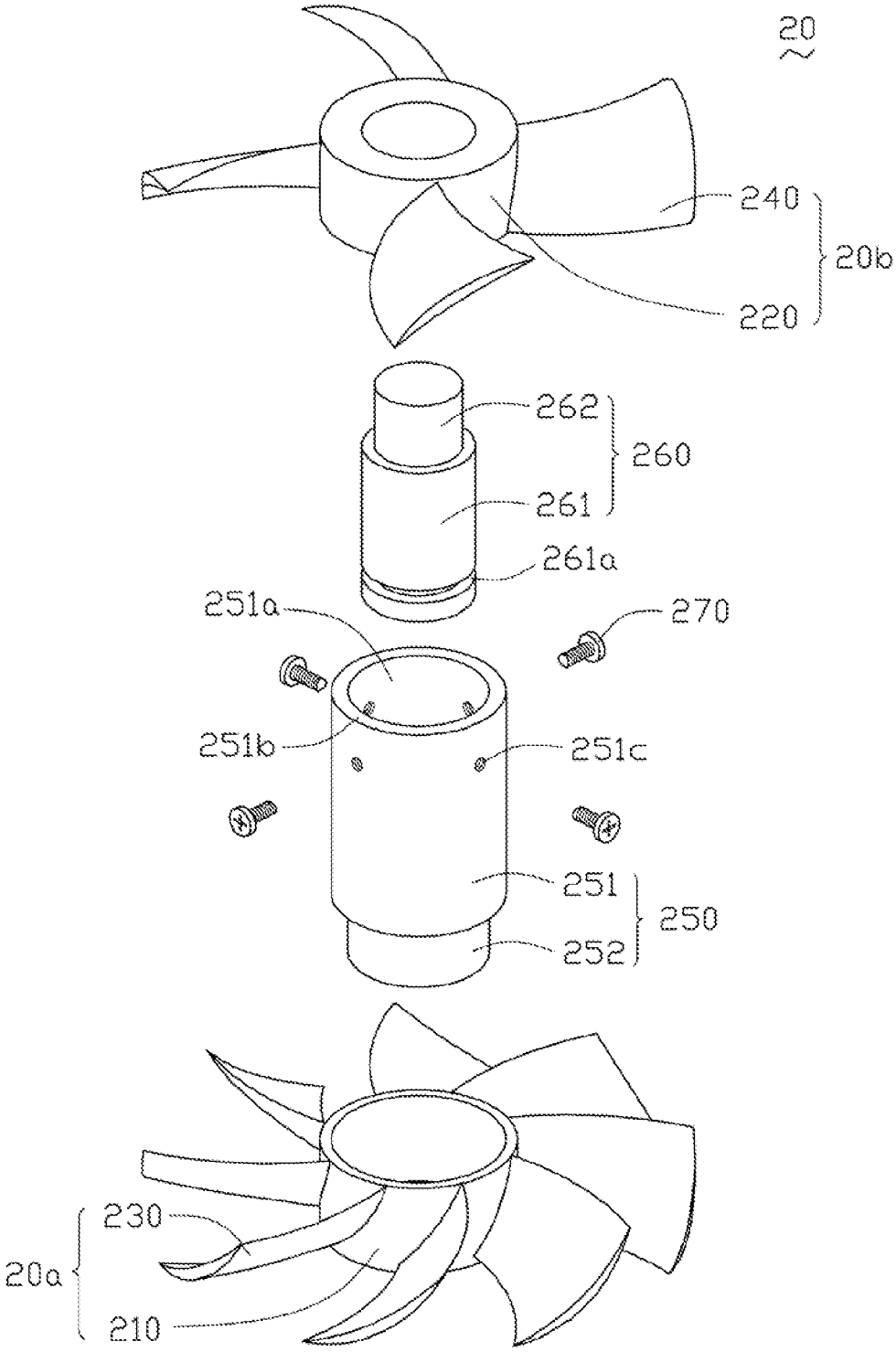
FIG. 1 is an isometric, exploded, schematic view of a fan, according to an exemplary embodiment.
Figure 2:
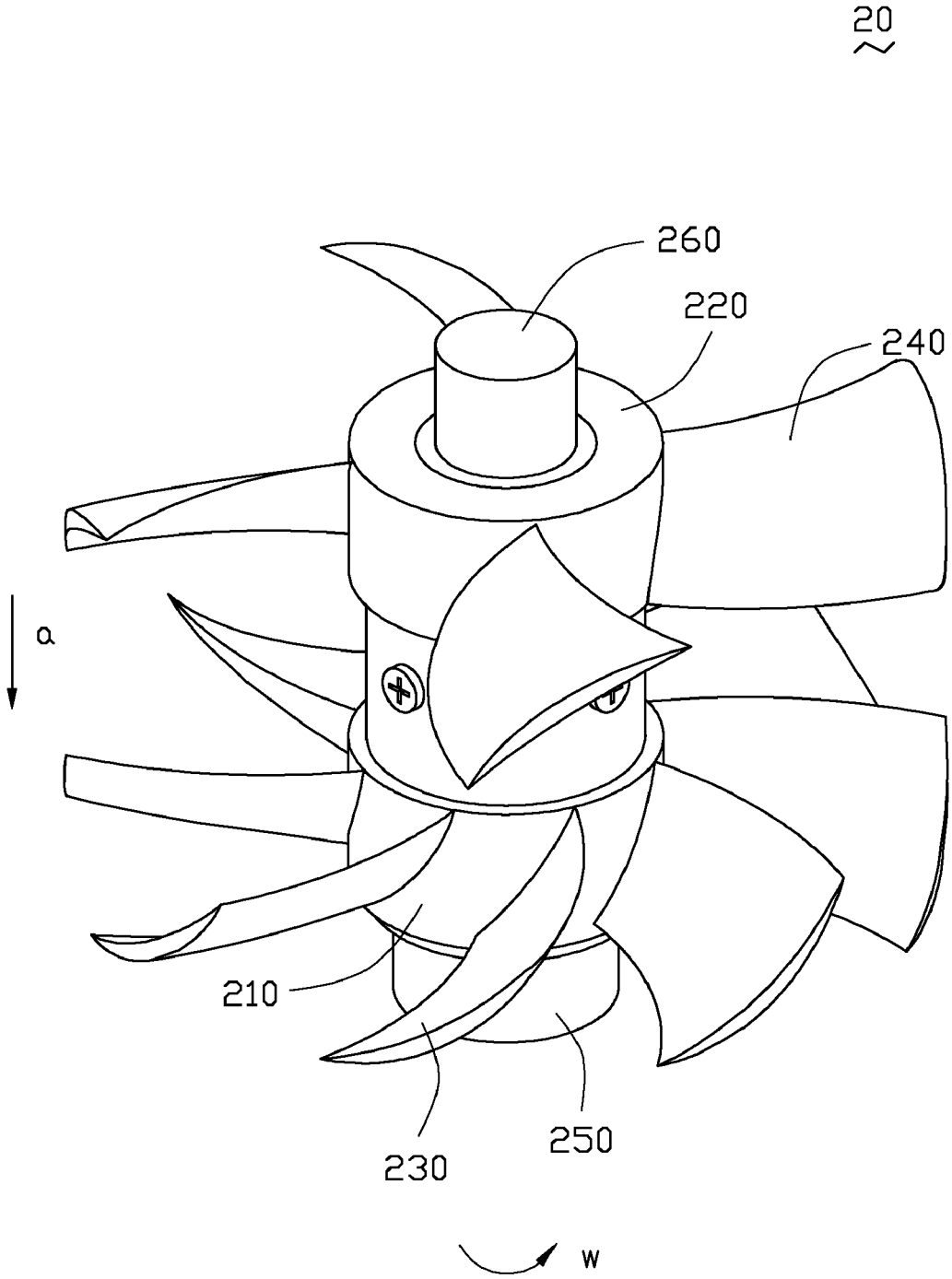
FIG. 2 is an isometric, assembled, schematic view of the fan of FIG. 1.

Referring to FIGS. 1-2, a fan 20, according to an exemplary embodiment, includes a first impeller 20*a*, a first motor 250, a second impeller 20*b*, and a second motor 260.

The first impeller 20*a* includes a first connecting portion 210 and eight first blades 230. The first connecting portion 210 is generally tubular. The first blades 230 are fixed to the outer surface of the first connecting portion 210 and arranged around the outer surface of the first connecting portion 210 with a uniform pitch. The first blades 230 are shaped and tilted so that when the first impeller 20*a* is driven to rotate along a direction ω, a main current of air created by the first impeller 20*a* flows along a direction α.

The first motor 250 includes a first stator 252 and a first rotor 251. The first stator 252 is generally cylindrical and can be secured to an outer frame (not shown). The first rotor 251 is substantially tubular and is coaxially connected to the first stator 252. The first rotor 251 has an outer diameter larger than the diameter of the stator 252 but substantially equal to the inner diameter of the first connecting portion 210. The first rotor 251 is longitudinally longer than the first connecting portion 210. As such, the first connecting portion 210 can be fixedly sleeved to an end of the first rotor 251 adjacent to the first stator 252. Another end of the first rotor 251 away from the first stator 252 defines four threaded holes 251*c* therethrough around the outer surface of the first rotor 251.

The second impeller 20*b* includes a second connecting portion 220 and four second blades 240. The second connecting portion 220 is generally tubular in shape. The second blades 240 are fixed to the outer surface of the second connecting portion 220 and arranged around the outer surface of the second connecting portion 220 with a uniform pitch. The second blades 240 are shaped and tilted so that when the second impeller 20*b* is driven to rotate along a reverse direction of ω, a main current of air created by the second impeller 20*b* also flows in the direction α.

The second motor 260 includes a second stator 262 and a second rotor 261. The second stator 262 is generally cylindrical and can be fixedly connected to the outer frame. The second rotor 261 is also cylindrical and is coaxially connected to the second stator 262. The diameter of the second rotor 261 and the inner diameter of the second connecting portion 220 are substantially equal to each other and larger than the diameter of the second stator 262. The second rotor 261 is longitudinally longer than the second connecting portion 220. As such, the second connecting portion 220 can be fittingly sleeved to an end of the second rotor 261. Another end of the second rotor 261 defines a groove 261*a*along the circumferential direction of the outer surface of the second rotor 261 and encircles the second rotor 261. The diameter of the second rotor 261 is slightly smaller than the inner diameter of the first rotor 251. Therefore, the second rotor 261 can be rotationally inserted into the first rotor 251 until the groove 261*a* is aligned with the threaded holes 251*c*. The fan 20 further includes four screws 270. The screws 270 are screwed into and extend through the four threaded holes 251*c* correspondingly and slidably received in the groove 261*a*. As such, the second rotor 261 is rotationally connected to the first rotor 251. As such, the first rotor 251 and the second rotor 261 are maintained in a rotational connection by the screws 270 and the groove 261*a* and can rotate freely with the screws 270 sliding in the groove 261*a* around the second rotor 261.

In operation, the first motor 250 drives the first impeller 20*a* to rotate along the direction ω to create a current of air of which a portion flows along the direction α and the rest flows outwards along the tangent of the impeller 20*a*. The second motor 260 drives the second impeller 20*b* to rotate along the reverse direction of ω to impel a current of air to also flowing along the tangent of the first impeller 20*a* in the direction α. To achieve a higher efficiency of the fan 20 in practical use, the number of the second blades 240 may be less than that of the first blades 230 and the power of the second motor 260 can be lower than that of the first motor 250. That is, the first motor 250 and the first impeller 20*a* work as the main, while the second motor 260 and the second impeller 20*b* works as the secondary. As such, only a small portion of the current of air created by the fan 20 flowing outward from the tangent of the second impeller 20*b* can not reach the source of heat, as compared with the current of air created by the fan 20 directing to the same direction α. Efficiency of the fan 20 is improved. However, it should be noted that the numbers of the first blades 230 and the second blades 240 are not limited to this embodiment.

In this embodiment, the first rotor 251 is rotationally connected to the second rotor 261 and contra-rotates in use. As such, the first motor 250 and the second motor 260 can dampen vibration for each other. Noise of the fan 20 is reduced.

While various exemplary and preferred embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A fan comprising:

a main impeller;

a main motor comprising a main rotor and configured for driving the main impeller to rotate along a first circular direction;

a secondary impeller; and a secondary motor comprising a secondary rotor and configured for driving the secondary impeller to rotate along a reverse direction of the first circular direction;

wherein the power of the main motor is greater than the power of the secondary motor, and the main rotor is rotationally connected to the secondary rotor;

wherein the main rotor is tube shaped and defines a plurality of threaded holes therethrough around the main rotor, the secondary rotor is cylindrical and defines a groove around the secondary rotor, the secondary rotor rotationally inserting the main rotor so that the threaded holes are aligned with the groove, the fan further comprising a plurality of screws screwing through the threaded holes respectively and slidably received in the groove.

* * * * *